US007884778B2

(12) United States Patent
Wu et al.

(10) Patent No.: US 7,884,778 B2
(45) **Date of Patent: *Feb. 8, 2011**

(54) ANTENNA STRUCTURE WITH ANTENNA RADOME AND METHOD FOR RISING GAIN THEREOF

(75) Inventors: Chun-Yih Wu, Taichung (TW); Shih-Huang Yeh, Douligu (TW); Chia-Lun Tang, Sanyi Township, Miaoli County (TW); Ken-Huang Lin, Kaohsiung (TW); Hsin-Lung Su, Kaohsiung (TW); Hsing-Nuan Liu, Changhua (TW)

(73) Assignee: Industrial Technology Research Institute, Hsinchu (TW)

( * ) Notice: Subject to any disclaimer, the term of this patent is extended or adjusted under 35 U.S.C. 154(b) by 80 days.

This patent is subject to a terminal disclaimer.

(21) Appl. No.: 11/606,893

(22) Filed: Dec. 1, 2006

(65) Prior Publication Data

US 2008/0001843 A1 Jan. 3, 2008

(30) Foreign Application Priority Data

Jun. 30, 2006 (TW) ..... 95123928 A

(51) Int. Cl.
*H01Q 1/42* (2006.01)
*H01Q 1/40* (2006.01)
*H01Q 15/02* (2006.01)

(52) U.S. Cl. ..... 343/872; 343/873; 343/909

(58) Field of Classification Search ..... 343/872, 343/873, 909, 911 R, 700 MS, 753, 756
See application file for complete search history.

(56) References Cited

U.S. PATENT DOCUMENTS

| | | | | |
|---|---|---|---|---|
| 4,479,128 | A | 10/1984 | Brunner et al. | |
| 2003/0142036 | A1 * | 7/2003 | Wilhelm et al. | 343/909 |
| 2005/0062673 | A1 * | 3/2005 | Wu et al. | 343/872 |
| 2005/0200540 | A1 * | 9/2005 | Isaacs et al. | 343/754 |

OTHER PUBLICATIONS

Stefan Enoch et al., "A Metamaterial for Directive Emission", Physical Review Letters, vol. 89, No. 21, Nov. 18, 2002, pp. 213902-1~213902-4.
Nicolas Guérin et al., "A Metallic Fabry-Perot Directive Antenna," IEEE Transactions on Antennas and Propagation, vol. 54, No. 1, Jan. 2006, pp. 220-224.
Hongsheng Chen et al., "Left-handed materials composed of only S-shaped resonators," Physical Review E, vol. 70, 057605, 2004, pp. 70 057605-1 through 70 057605-4.
Tomasz M. Grzegorczyk et al., "Properties of Left-Handed Metamaterials: Transmission, Backward Phase, Negative Refraction, and Focusing," IEEE Transactions on Microwave Theory and Techniques, vol. 53, No. 9, Sep. 2005, pp. 2956-2967.

(Continued)

*Primary Examiner*—Jacob Y Choi
*Assistant Examiner*—Robert Karacsony
(74) *Attorney, Agent, or Firm*—Rabin & Berdo, PC

(57) ABSTRACT

An antenna structure includes a radiating element and an antenna radome. The antenna radome has at least one dielectric layer, which has an upper surface having many S-shaped metal patterns and a lower surface having many inverse S-shaped metal patterns corresponding to the S-shaped metal patterns. The S-shaped metal patterns are respectively coupled to the corresponding inverse S-shaped metal patterns to converge radiating beams outputted from the radiating element.

56 Claims, 6 Drawing Sheets

OTHER PUBLICATIONS

J. A. Kong et al., "Application of hyperbolic dispersion relations of left-handed metamaterials," Microwave Conference Proceedings 2005, APMC 2005, Asia-Pacific Conference Proceedings, vol. 1, Dec. 4-7, 2005, 4 pages.

* cited by examiner

ANTENNA STRUCTURE WITH ANTENNA RADOME AND METHOD FOR RISING GAIN THEREOF

This application claims the benefit of Taiwan application Serial No. 95123928, filed Jun. 30, 2006, the subject matter of which is incorporated herein by reference.

BACKGROUND OF THE INVENTION

1. Field of the Invention

The invention relates in general to an antenna structure with an antenna radome and a method for raising a gain thereof, and more particularly to an antenna structure, which has an antenna radome, a high gain and a simple structure, and a method for raising a gain thereof.

2. Description of the Related Art

Recently, the wireless communication technology is developed rapidly, so the wireless local area network (Wireless LAN) or the wireless personal area network (Wireless PAN) has been widely used in the office or home. However, the wired network, such as a DSL (Digital Subscriber Line), is still the mainstream for connecting various wireless networks. In order to wireless the networks in the cities and to build the backbone network appliance between the city and the country with a lower cost, a WiMAX (Worldwide Interoperability for Microwave Access) protocol of IEEE 802.16a having the transmission speed of 70 Mbps, which is about 45 times faster than that of the current T1 network having the speed of 1.544 Mbps, is further proposed. In addition, the cost of building the WiMAX network is also lower than that of building the T1 network.

Because the layout of the access points in the backbone network is usually built in a long distance and peer-to-peer manner. Thus, the high directional antenna plays an important role therein so as to enhance the EIRP (Effective Isotropically Radiated Power) and to achieve the object of implementing the long distance transmission with a lower power. Meanwhile, the converged radiating beams can prevent the neighboring zones from being interfered. The conventional high directional antenna may be divided into a disk antenna and an array antenna. The disk antenna has an extremely high directional gain, but an extremely large size. So, it is difficult to build the disk antenna, and the disk antenna tends to be influenced by the external climate.

When the required directional gain of the array antenna increases, the number of array elements grows with a multiplier, the antenna area greatly increases, and the material cost also increases greatly. Meanwhile, the feeding network, which is one of the important elements constituting the antenna array, becomes complicated severely. The feeding network is in charge of collecting the energy of each of the antenna array elements to the output terminal as well as to ensure no phase deviation between the output terminal and each of the antenna array elements. Thus, the problems of phase precision and transmitted energy consumption occur such that the antenna gain cannot increase with the increase of the number of array elements.

In 2002, G. Tayeb etc. discloses a "Compact directive antennas using metamaterials" in 12th International Symposium on Antennas, Nice, 12-14 Nov. 2002, in which the metamaterial antenna radome having a multi-layer metal grid is proposed. The electromagnetic bandgap technology is utilized to reduce the half power beamwidth (only about 10 degrees) of the microstrip antenna greatly in the operation frequency band of 14 GHz, and thus to have the extremely high directional gain. Based on the equation of $c=f\times\lambda$, however, when the antenna is applied in a WiMAX system with the operation frequency band of 3.5 GHz to 5 GHz, the wavelength is greatly lengthened because the frequency is greatly lowered. Thus, the antenna radome has to possess the relatively large thickness correspondingly, and the overall size of the antenna increases. Meanwhile, the multi-layer metal grid acts on the far-field of the antenna radiating field, so the overall size of the antenna structure increases and the utility thereof is restricted.

SUMMARY OF THE INVENTION

It is therefore an object of the invention to provide an antenna structure with an antenna radome and a method of raising a gain thereof. A dielectric layer formed with metal patterns is utilized such that the antenna radome made of a metamaterial may be placed in a near-field of the radiating field of the antenna structure. Thus, the beamwidth of the radiating beams of the antenna structure can be converged to increase the gain of the antenna structure and the size of the antenna structure can be greatly reduced.

The invention achieves the above-identified object by providing an antenna structure including a radiating element and an antenna radome. The antenna radome has at least one dielectric layer, which has an upper surface formed with a plurality of S-shaped metal patterns, and a lower surface formed with a plurality of inverse S-shaped metal patterns corresponding to the S-shaped metal patterns. The S-shaped metal patterns are respectively coupled to the corresponding inverse S-shaped metal patterns to converge radiating beams outputted from the radiating element.

The invention also achieves the above-identified object by providing another antenna structure including a radiating element and an antenna radome. The antenna radome has at least one dielectric layer, which has an upper surface formed with a plurality of metal patterns, and a lower surface formed with a plurality of inverse metal patterns corresponding to the metal patterns. A gap between the metal patterns ranges from 0.002 to 0.2 times of a wavelength of a resonance frequency of the radiating element, and a gap between the inverse metal patterns ranges from 0.002 to 0.2 times of the wavelength of the resonance frequency of the radiating element. The metal patterns are respectively coupled to the corresponding inverse metal patterns to converge radiating beams outputted from the radiating element.

The invention also achieves the above-identified object by providing an antenna radome including at least one dielectric layer, a plurality of S-shaped metal patterns and a plurality of inverse S-shaped metal patterns. The S-shaped metal patterns are formed on an upper surface of the at least one dielectric layer by way of printing or etching. The inverse S-shaped metal patterns respectively correspond to the S-shaped metal patterns and are formed on a lower surface of the at least one dielectric layer by way of printing or etching. The S-shaped metal patterns are respectively coupled to the corresponding inverse S-shaped metal patterns to converge radiating beams outputted from a radiating element.

The invention also achieves the above-identified object by providing an antenna radome including at least one dielectric layer, a plurality of metal patterns and a plurality of inverse metal patterns. The metal patterns are formed on an upper surface of the at least one dielectric layer by way of printing or etching. The plurality of inverse metal patterns respectively correspond to the metal patterns and are formed on a lower surface of the at least one dielectric layer by way of printing or etching. A gap between the metal patterns ranges from 0.002 to 0.2 times of a wavelength of a resonance frequency of a radiating element, and a gap between the inverse metal patterns ranges from 0.002 to 0.2 times of the wavelength of the resonance frequency of the radiating element. The metal patterns are respectively coupled to the corresponding inverse metal patterns to converge radiating beams outputted from the radiating element.

The invention also achieves the above-identified object by providing a method of raising a gain of an antenna structure. The method includes the steps of: providing a radiating element; and placing an antenna radome above the radiating element to converge radiating beams outputted from the radiating element. The antenna radome has at least one dielectric layer, which has an upper surface formed with a plurality of S-shaped metal patterns by way of printing or etching, and a lower surface formed, by way of printing or etching, with a plurality of inverse S-shaped metal patterns respectively corresponding to the S-shaped metal patterns. The S-shaped metal patterns are respectively coupled to the corresponding inverse S-shaped metal patterns to converge the radiating beams outputted from the radiating element.

Other objects, features, and advantages of the invention will become apparent from the following detailed description of the preferred but non-limiting embodiment. The following description is made with reference to the accompanying drawings.

DETAILED DESCRIPTION OF THE INVENTION

The invention provides an antenna structure with an antenna radome and a method of raising a gain thereof. A dielectric layer formed with metal patterns is utilized such that the antenna radome can be placed in a near-field of a radiating field of the antenna structure. Thus, the beamwidth of the radiating beams of the antenna structure can be converged to increase the gain of the antenna structure.

Figure 1:
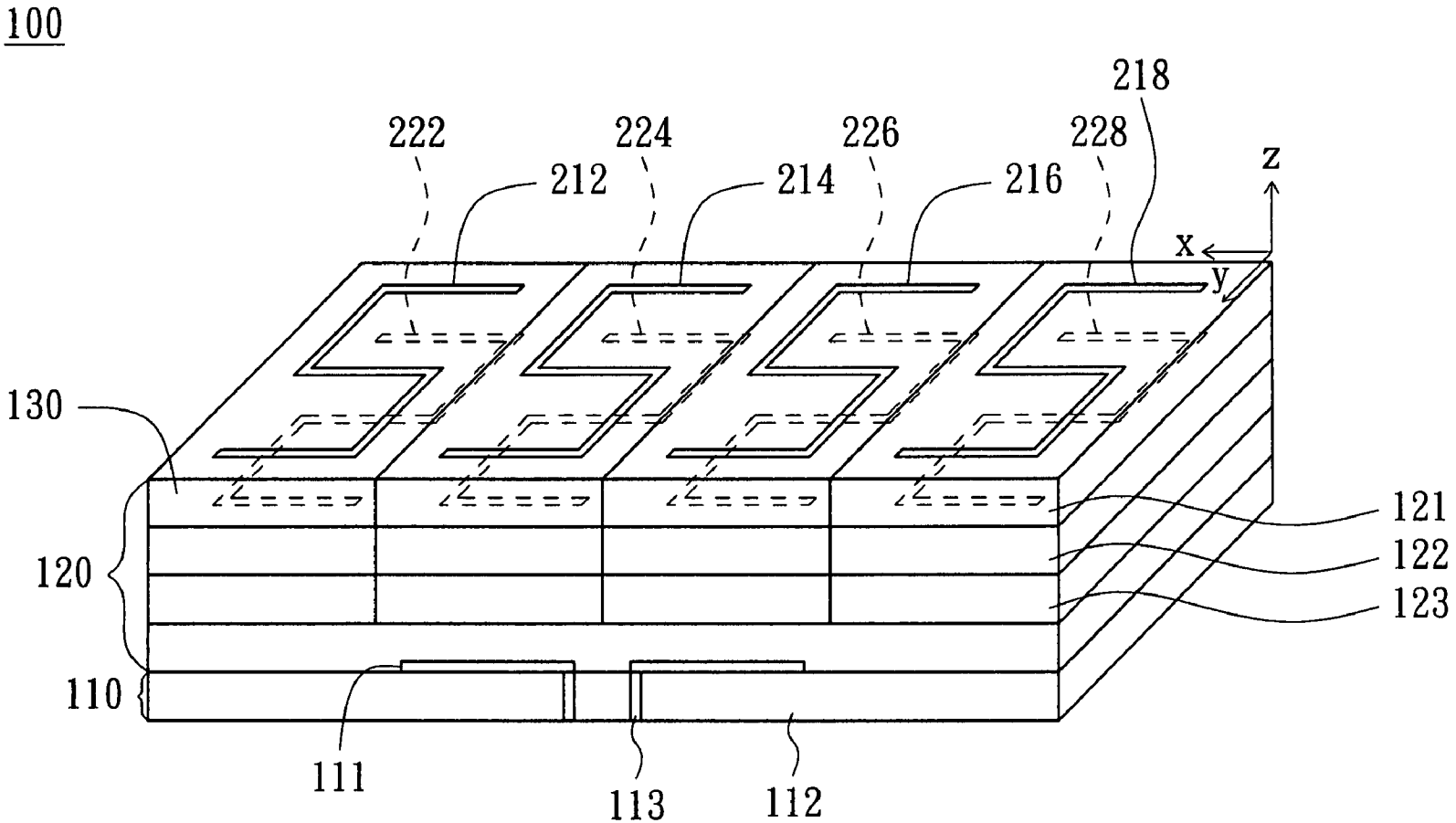
FIG. 1 is a schematic illustration showing an antenna structure according to a preferred embodiment of the invention.

FIG. 1 is a schematic illustration showing an antenna structure 100 according to a preferred embodiment of the invention. Referring to FIG. 1, the antenna structure 100 includes a radiating element 110 and an antenna radome 120. The radiating element 110 includes a radiating main body 111, a medium element 112 and an antenna feeding end 113. The radiating main body 111 is disposed on the medium element 112, and the antenna feeding end 113 feeds signals. The radiating element 110 may be any type of antenna and is not restricted to a specific type of antenna.

Figure 2B:
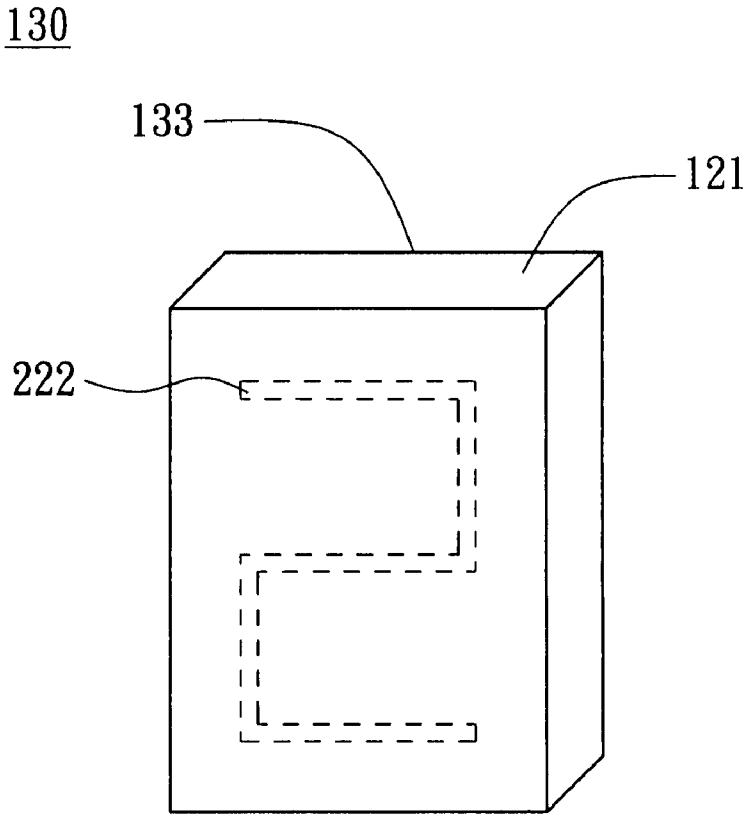
FIG. 2B is a schematic illustration showing a metal pattern on a backside of a single array element of the antenna structure according to the preferred embodiment of the invention.
Figure 2A:
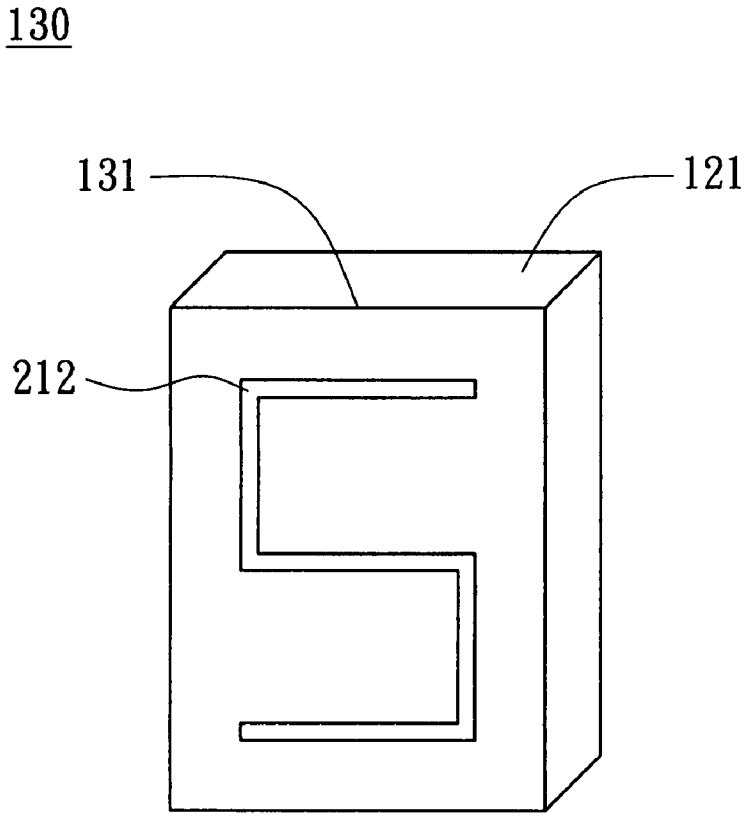
FIG. 2A is a schematic illustration showing a metal pattern on a face side of a single array element of the antenna structure according to the preferred embodiment of the invention.

The antenna radome 120 is made of a metamaterial, and has at least one dielectric layer. In this embodiment, the antenna radome 120 has, without limitation to, three dielectric layers including a dielectric material layer 121, a dielectric material layer 122 and a dielectric material layer 123. The upper surfaces of the dielectric material layers 121 to 123 are formed with multiple S-shaped metal patterns 212 to 218, and the lower surfaces of the dielectric material layers 121 to 123 are formed with multiple inverse S-shaped metal patterns 222 to 228 respectively corresponding to the S-shaped metal patterns 212 to 218. The antenna radome 120 may also be regarded as being composed of multiple array elements 130. FIG. 2A is a schematic illustration showing a metal pattern on a face side of a single array element of the antenna structure according to the preferred embodiment of the invention. Referring to FIG. 2A, the array element 130 includes the dielectric material layer 121 and has an upper surface 131 formed with the S-shaped metal pattern 212. FIG. 2B is a schematic illustration showing a metal pattern on a backside of a single array element of the antenna structure according to the preferred embodiment of the invention. Referring to FIG. 2B, the array element 130 includes the dielectric material layer 121 and has a lower surface 133 having the inverse S-shaped metal pattern 222.

In the antenna radome 120, a gap between the S-shaped metal patterns 212 to 218 ranges from 0.002 to 0.2 times of the wavelength of the resonance frequency of the radiating element 110. A gap between the inverse S-shaped metal patterns 222 to 228 ranges from 0.002 to 0.2 times of the wavelength of the resonance frequency of the radiating element 110. The S-shaped metal patterns 212 to 218 and the inverse S-shaped metal patterns 222 to 228, which are formed on the dielectric material layer 121 by way of printing or etching, have simple structures and may be manufactured using the current printed circuit board (PCB) process. So, the manufacturing cost thereof may be reduced greatly.

Figure 3A:
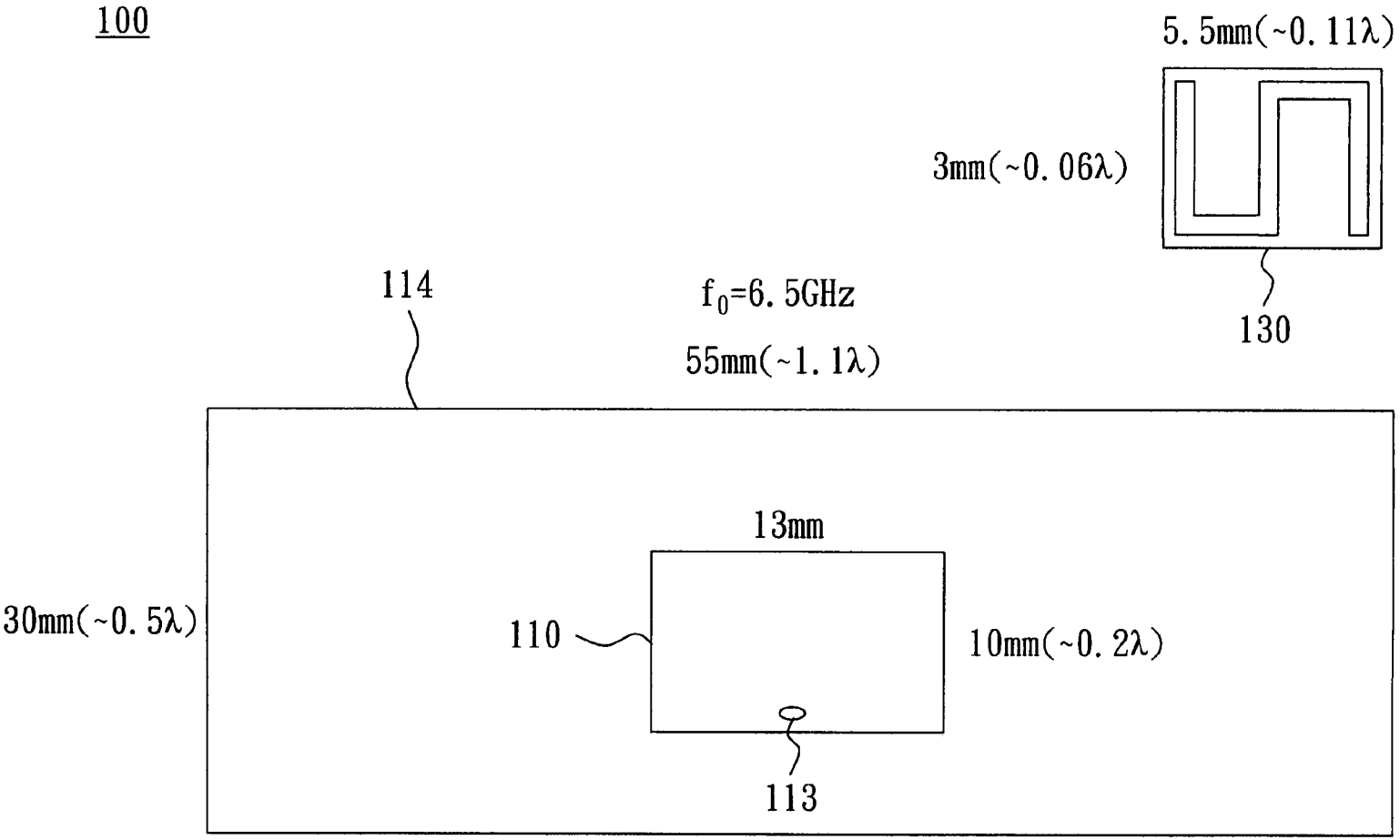
FIG. 3A is a top view showing the antenna structure according to the preferred embodiment of the invention.
Figure 3B:
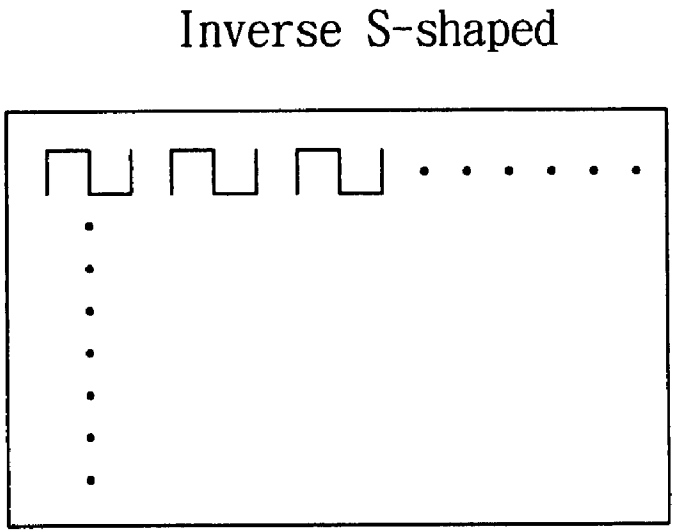
FIG. 3B is a schematic illustration showing an upper surface and a lower surface of a single layer of array element of the antenna structure according to the preferred embodiment of the invention.
Figure 3B:
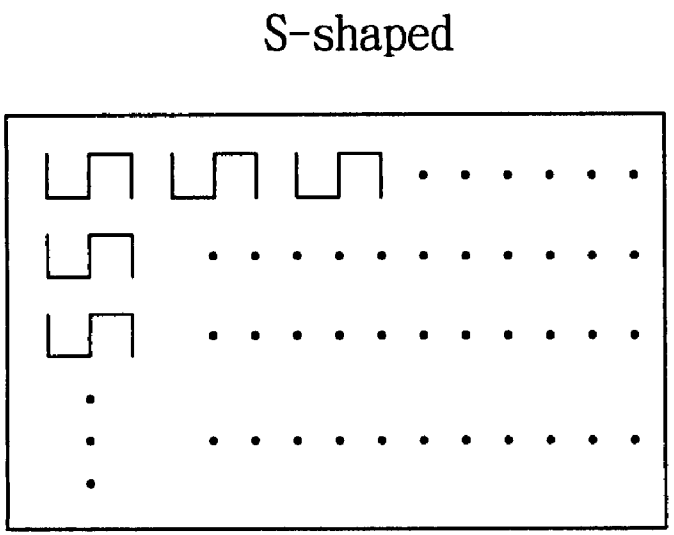

FIG. 3A is a top view showing the antenna structure according to the preferred embodiment of the invention. As shown in FIG. 3A, the antenna structure 100 of this embodiment has, without limitation to, 10×10 array elements. In this embodiment, the frequency is about 6.5 GHz. In this case, the size of the radiating element 110 is about 13 mm×10 mm (about 0.2 times of the wavelength), and the antenna feeding end 113 is disposed on the radiating element 110. In addition, the size of the array element 130 is about 5.5 mm (about 0.11 times of the wavelength)×3 mm (about 0.06 times of the wavelength). So, when the antenna structure 100 has 10×10 array elements, the size of a ground 114 is about 55 mm (about 1.1 times of the wavelength)×30 mm (about 0.5 times of the wavelength). FIG. 3B is a schematic illustration showing an upper surface and a lower surface of a single layer of array element of the antenna structure according to the preferred embodiment of the invention. As shown in FIG. 3B, the single layer of array element of the antenna structure 100 has an upper surface formed with multiple S-shaped metal patterns, and a lower surface formed with multiple inverse S-shaped metal patterns.

Figure 4:
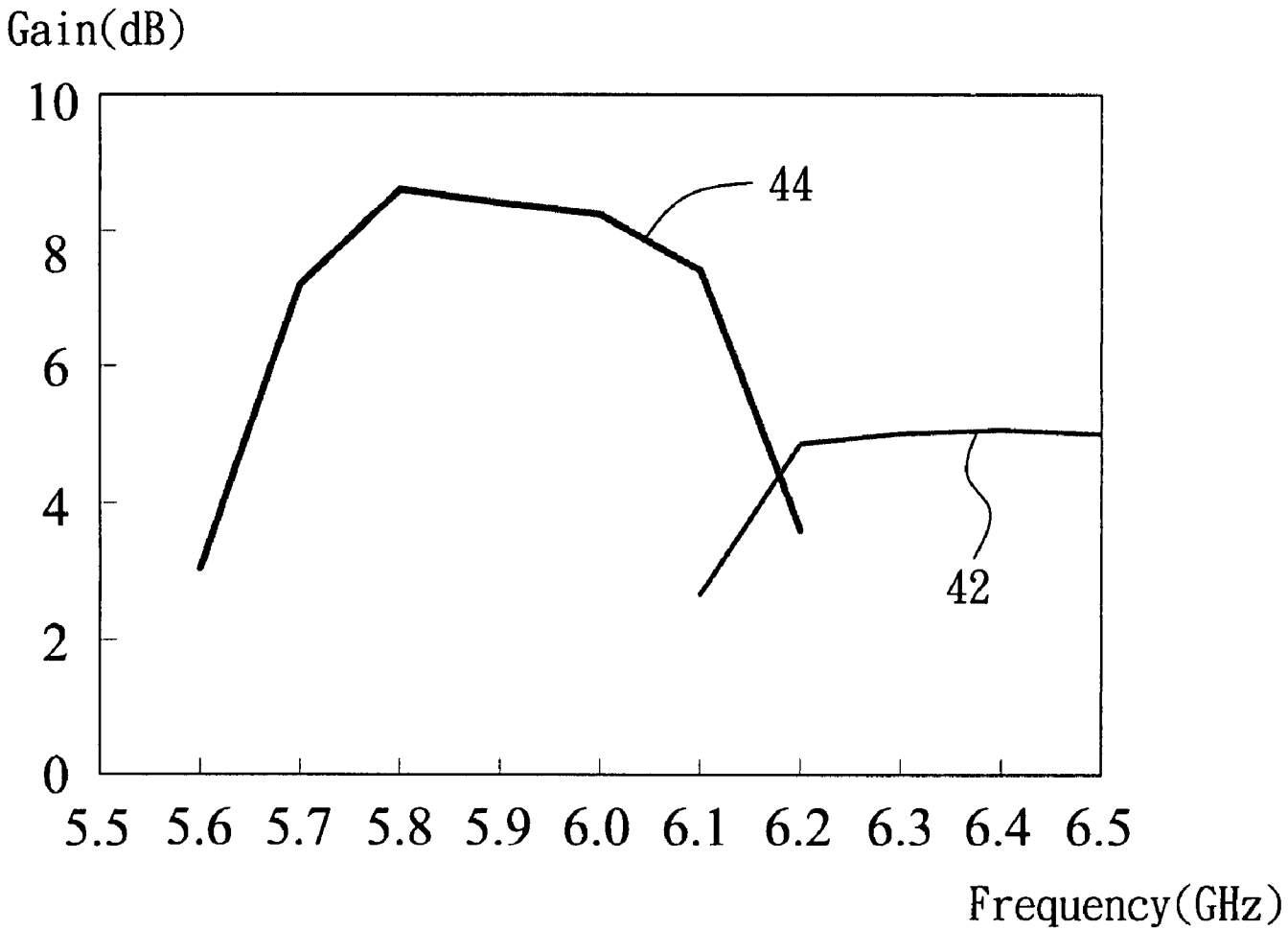
FIG. 4 shows a gain frequency response curve of the antenna structure according to the preferred embodiment of the invention.
Figure 5:
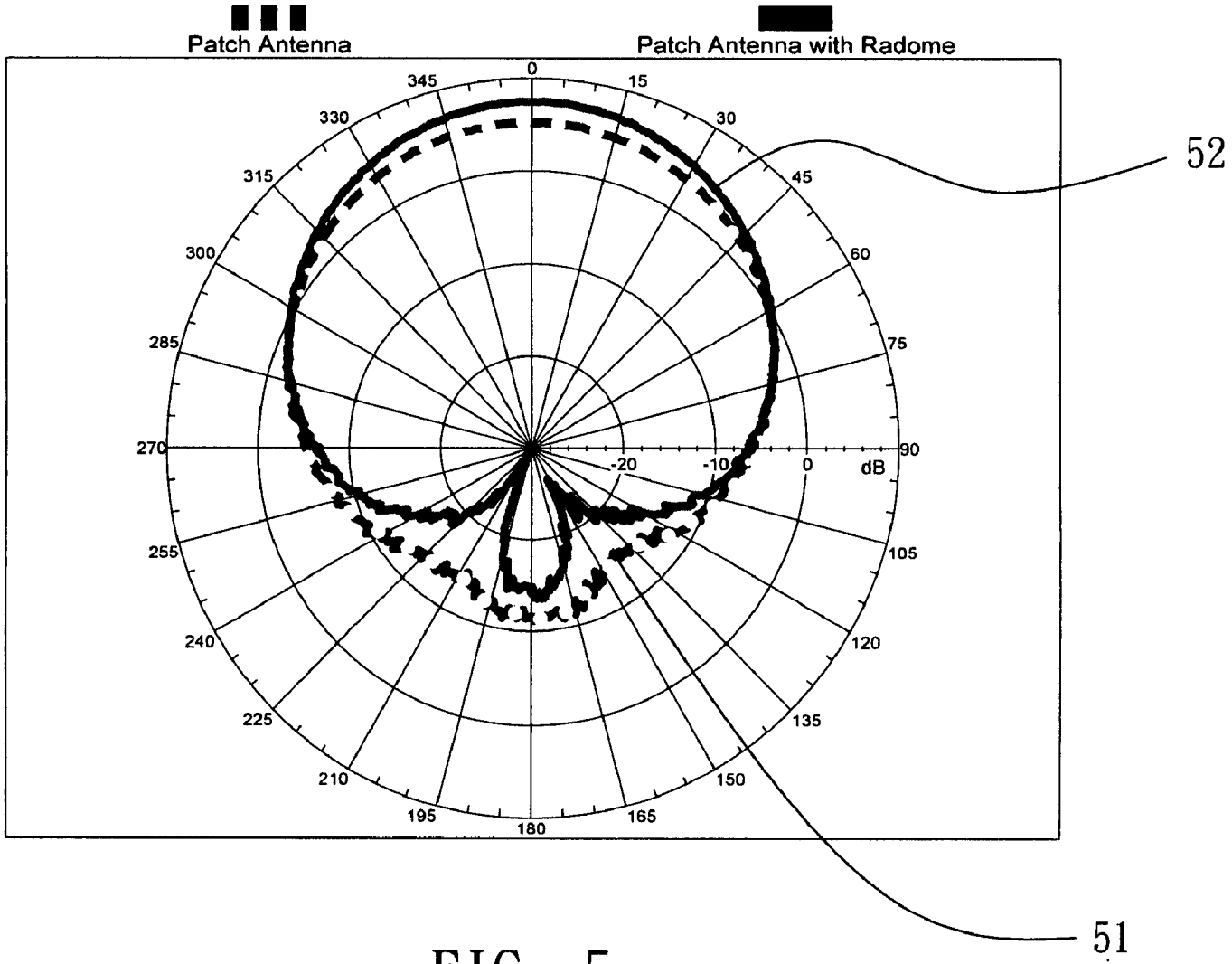
FIG. 5 shows a radiating pattern chart of the antenna structure according to the preferred embodiment of the invention.

The method of the invention for raising a gain of the antenna structure is to attach the antenna radome 120 to the radiating element 110 to converge the radiating beams emitted by the radiating element 110. The antenna radome 120 is placed at a near-field position of an electromagnetic field created by the radiating element 110. The S-shaped metal patterns 212 to 218 are respectively coupled to the corresponding inverse S-shaped metal patterns 222 to 228 to converge the radiating beams outputted from the radiating element 110, so that the beamwidth of the radiating beams is decreased, and the gain of the antenna structure 100 is increased. FIG. 4 shows a gain frequency response curve of the antenna structure according to the preferred embodiment of the invention. As shown in FIG. 4, the radiating element 110 is a microstrip antenna, the symbol 42 denotes the gain frequency response curve of the single microstrip antenna, and the symbol 44 denotes the gain frequency response curve of the antenna radome of the invention plus the microstrip antenna. As shown in FIG. 4, the single microstrip antenna has the maximum gain of 5.07 dBi at 6.4 GHz, and the antenna radome of the invention plus the microstrip antenna have the maximum gain of 8.61 dBi at 5.8 GHz. So, the gain of about 3.54 dBi is increased. FIG. 5 shows a radiating pattern chart of the antenna structure according to the preferred embodiment of the invention. The radiation pattern of FIG. 5 is measured based on the antenna structure 100 of the FIG. 1. The symbol 51 denotes the radiation property of the single microstrip antenna, and the symbol 52 denotes the radiation property of the antenna radome of the invention plus the microstrip antenna. As shown in FIG. 5, after the metal antenna radome is added, the embodiment generates the field type of converged radiation on the x-z plane, and is thus very suitable for the actual application of the directional antenna.

The metal patterns on the dielectric material layers 121 to 123 are not restricted to the S-shaped metal patterns and the inverse S-shaped metal patterns in the antenna structure 100 mentioned hereinabove. Any metal pattern having the gap ranging between 0.002 to 0.2 times of the wavelength of the resonance frequency of the radiating element 110 can be used in the antenna structure 100 of this invention as long as the metal patterns formed on the upper and lower surfaces can be coupled to each other. In addition, the dielectric constants and the magnetic coefficients of the dielectric material layers 121 to 123 may be the same as or different from one another in the antenna structure 100. For example, the magnetic coefficients of the dielectric material layer 121 and the dielectric material layer 123 are the same, but are unequal to the magnetic coefficient of the dielectric material layer 122. Alternatively, the magnetic coefficients of the dielectric material layers 121 to 123 may be different from one another. The relationships between the dielectric constants of the dielectric material layers 121 to 123 may also be similar to those of the magnetic coefficients. When the dielectric constants and the magnetic coefficients of the dielectric material layers 121 to 123 are different from one another, the gap between the S-shaped metal patterns and the gap between the inverse S-shaped metal patterns have to be adjusted slightly but still range from 0.002 to 0.2 times of the wavelength of the resonance frequency of the radiating element 110.

According to the antenna structure, the antenna radome and the method of raising the gain of the antenna structure according to the embodiment of the invention, the metal patterns coupled to each other are formed on the dielectric material layer by way of printing or etching, and the antenna radome is placed in the near-field of the radiating field of the antenna structure to converge the beamwidth of the radiating beams outputted from the antenna structure and thus to increase the gain of the antenna structure. The metal patterns have the feature of the simple structure, and can be manufactured using the current PCB manufacturing process so that the manufacturing cost can be greatly reduced. In addition, because the antenna radome is placed in the near-field of the antenna structure, the size of the overall antenna structure can be further minimized, and the utility can be enhanced.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna structure, comprising:

a radiating element; and an antenna radome, placed within a near-field of the radiating element, the antenna radome comprising:

a plurality of S-shaped metal patterns;

a plurality of inverse S-shaped metal patterns, corresponding to the S-shaped metal patterns respectively; and a plurality of dielectric layers, at least comprising a first dielectric layer and a second dielectric layer, an upper surface of the first dielectric layer being formed with part of the S-shaped metal patterns, a lower surface of the first dielectric layer being formed with the corresponding inverse S-shaped metal patterns, an upper surface of the second dielectric layer being formed with another part of the S-shaped metal patterns, a lower surface of the second dielectric layer being formed with the corresponding inverse S-shaped metal patterns;

wherein the S-shaped metal patterns are respectively coupled to the corresponding inverse S-shaped metal patterns to converge radiating beams in the propagation direction of the radiating beams outputted from the radiating element.

2. The antenna structure according to claim 1, wherein a gap between the S-shaped metal patterns ranges from 0.002 to 0.2 times of a wavelength of a resonance frequency of the radiating element.

3. The antenna structure according to claim 1, wherein a gap between the inverse S-shaped metal patterns ranges from 0.002 to 0.2 times of a wavelength of a resonance frequency of the radiating element.

4. The antenna structure according to claim 1, wherein the dielectric layers comprise more than two dielectric material layers having the same magnetic coefficient.

5. The antenna structure according to claim 1, wherein the dielectric layers comprise more than two dielectric material layers having different magnetic coefficients.

6. The antenna structure according to claim 1, wherein the dielectric layers comprise more than two dielectric material layers, one portion of which has the same magnetic coefficient, and the other portion of which has different magnetic coefficients.

7. The antenna structure according to claim 1, wherein the dielectric layers comprise more than two dielectric material layers having the same dielectric constant.

8. The antenna structure according to claim 1, wherein the dielectric layers comprise more than two dielectric material layers having different dielectric constants.

9. The antenna structure according to claim 1, wherein the dielectric layers comprise more than two dielectric material layers, one portion of which has the same dielectric constant, and the other portion of which has different dielectric constants.

10. The antenna structure according to claim 1, wherein the antenna radome is made of a metamaterial.

11. The antenna structure according to claim 1, wherein the radiating element is an antenna.

12. The antenna structure according to claim 1, wherein the S-shaped metal patterns and the corresponding inverse S-shaped metal patterns are disposed in pairs, and the inverse S-shaped metal patterns are obtained by rotating the corresponding S-shaped metal patterns according to one axis to be opposite in order to the corresponding S-shaped metal patterns.

13. An antenna structure, comprising:

a radiating element; and an antenna radome, comprising:

a plurality of metal pattern;

a plurality of inverse metal patterns, corresponding to the metal patterns respectively; and a plurality of dielectric layers, at least comprising a first dielectric layer and a second dielectric layer, an upper surface of the first dielectric layer being formed with part of the metal patterns, a lower surface of the first dielectric layer being formed with the corresponding inverse metal patterns, an upper surface of the second dielectric layer being formed with another part of the metal patterns, a lower surface of the second dielectric layer being formed with the corresponding inverse metal patterns;

wherein a gap between the metal patterns ranges from 0.002 to 0.2 times of a wavelength of a resonance frequency of the radiating element, and a gap between the inverse metal patterns ranges from 0.002 to 0.2 times of the wavelength of the resonance frequency of the radiating element;

wherein the metal patterns are respectively coupled to the corresponding inverse metal patterns to converge radiating beams in the propagation direction of the radiating beams outputted from the radiating element.

14. The antenna structure according to claim 13, wherein the dielectric layers comprise more than two dielectric material layers having the same magnetic coefficient.

15. The antenna structure according to claim 13, wherein the dielectric layers comprise more than two dielectric material layers having different magnetic coefficients.

16. The antenna structure according to claim 13, wherein the dielectric layer comprises layers comprise more than two dielectric material layers, one portion of which has the same magnetic coefficient, and the other portion of which has different magnetic coefficients.

17. The antenna structure according to claim 13, wherein the dielectric layers comprise more than two dielectric material layers having the same dielectric constant.

18. The antenna structure according to claim 13, wherein the dielectric layers comprise more than two dielectric material layers having different dielectric constants.

19. The antenna structure according to claim 13, wherein the dielectric layers comprise more than two dielectric material layers, one portion of which has the same dielectric constant, and the other portion of which has different dielectric constants.

20. The antenna structure according to claim 13, wherein, the antenna radome is made of a metamaterial.

21. The antenna structure according to claim 13, wherein the radiating element is an antenna.

22. The antenna structure according to claim 13, wherein the metal patterns and the corresponding inverse metal patterns are disposed in pairs, and the inverse metal patterns are obtained by rotating the corresponding metal patterns according to one axis to be opposite in order to the corresponding metal patterns.

23. An antenna radome, comprising:

a plurality of S-shaped metal patterns;

a plurality of inverse S-shaped metal patterns, corresponding to the S-shaped metal patterns respectively; and a plurality of dielectric layers, at least comprising a first dielectric layer and a second dielectric layer, an upper surface of the first dielectric layer being formed with part of the S-shaped metal patterns, a lower surface of the first dielectric layer being formed with the corresponding inverse S-shaped metal patterns, an upper surface of the second dielectric layer being formed with another part of the S-shaped metal patterns, a lower surface of the second dielectric layer being formed with the corresponding inverse S-shaped metal patterns;

wherein the S-shaped metal patterns are respectively coupled to the corresponding inverse S-shaped metal patterns to converge radiating beams in the propagation direction of the radiating beams outputted from a radiating element of which the antenna radome is placed within a near-field.

24. The antenna radome according to claim 23, wherein the antenna radome is made of a metamaterial.

25. The antenna radome according to claim 23, wherein a gap between the S-shaped metal patterns ranges from 0.002 to 0.2 times of a wavelength of a resonance frequency of the radiating element.

26. The antenna radome according to claim 23, wherein a gap between the inverse S-shaped metal patterns ranges from 0.002 to 0.2 times of a wavelength of a resonance frequency of the radiating element.

27. The antenna radome according to claim 23, wherein the dielectric layers comprise more than two dielectric material layers having the same magnetic coefficient.

28. The antenna radome according to claim 23, wherein the dielectric layers comprise more than two dielectric material layers having different magnetic coefficients.

29. The antenna radome according to claim 23, wherein the dielectric layers comprise more than two dielectric material layers, one portion of which has the same magnetic coefficient, and the other portion of which has different magnetic coefficients.

30. The antenna radome according to claim 23, wherein the dielectric layers comprise more than two dielectric material layers having the same dielectric constant.

31. The antenna radome according to claim 23, wherein the dielectric layers comprise more than two dielectric material layers having different dielectric constants.

32. The antenna radome according to claim 23, wherein the dielectric layers comprise more than two dielectric material layers, one portion of which has the same dielectric constant, and the other portion of which has different dielectric constants.

33. The antenna radome according to claim 23, wherein the radiating element is an antenna.

34. The antenna radome according to claim 23, wherein the S-shaped metal patterns and the corresponding inverse S-shaped metal patterns are disposed in pairs, and the inverse S-shaped metal patterns are obtained by rotating the corresponding S-shaped metal patterns according to one axis to be opposite in order to the corresponding S-shaped metal patterns.

35. An antenna radome, comprising:

a plurality of metal patterns;

a plurality of inverse metal patterns, corresponding to the metal patterns respectively; and a plurality of dielectric layers, at least comprising a first dielectric layer and a second dielectric layer, an upper surface of the first dielectric layer being formed with part of the metal patterns, a lower surface of the first dielectric layer being formed with the corresponding inverse metal patterns, an upper surface of the second dielectric layer being formed with another part of the metal patterns, a lower surface of the second dielectric layer being formed with the corresponding inverse metal patterns;

wherein a gap between the metal patterns ranges from 0.002 to 0.2 times of a wavelength of a resonance frequency of a radiating element of which the antenna radome is placed within a near-field, and a gap between the inverse metal patterns ranges from 0.002to 0.2 times of the wavelength of the resonance frequency of the radiating element; and wherein the metal patterns are respectively coupled to the corresponding inverse metal patterns to converge radiating beams in the propagation direction of the radiating beams outputted from the radiating element.

36. The antenna radome according to claim 35, wherein the antenna radome is made of a metamaterial.

37. The antenna radome according to claim 35, wherein the dielectric layers comprise more than two dielectric material layers having the same magnetic coefficient.

38. The antenna radome according to claim 35, wherein the dielectric layers comprise more than two dielectric material layers having different magnetic coefficients.

39. The antenna radome according to claim 35, wherein the dielectric layers comprise more than two dielectric material layers, one portion of which has the same magnetic coefficient, and the other portion of which has different magnetic coefficients.

40. The antenna radome according to claim 35, wherein the dielectric layers comprise more than two dielectric material layers having the same dielectric constant.

41. The antenna radome according to claim 35, wherein the dielectric layers comprise more than two dielectric material layers having different dielectric constants.

42. The antenna radome according to claim 35, wherein the dielectric layers comprise more than two dielectric material layers, one portion of which has the same dielectric constant, and the other portion of which has different dielectric constants.

43. The antenna radome according to claim 35, wherein the radiating element is an antenna.

44. The antenna radome according to claim 35, wherein the metal patterns and the corresponding inverse metal patterns are disposed in pairs, and the inverse metal patterns are obtained by rotating the corresponding metal patterns according to one axis to be opposite in order to the corresponding metal patterns.

45. A method of raising a gain of an antenna structure, the method comprising the steps of:

providing a radiating element; and placing an antenna radome above and within a near field of the radiating element to converge radiating beams outputted from the radiating element, wherein:

the antenna radome comprises a plurality of S-shaped metal patterns, a plurality of inverse S-shaped metal patterns corresponding to the S-shaped metal patterns respectively, and a plurality of dielectric layers, the dielectric layers at least comprising a first dielectric layer and a second dielectric layer, an upper surface of the first dielectric layer being formed with part of the S-shaped metal patterns by way of printing or etching, a lower surface of the first dielectric layer being formed with the corresponding inverse S-shaped metal patterns by way of printing or etching, an upper surface of the second dielectric layer being formed with part of the S-shaped metal patterns by way of printing or etching, a lower surface of the second dielectric being formed with the corresponding inverse S-shaped metal patterns by way of printing or etching, and the S-shaped metal patterns are respectively coupled to the corresponding inverse S-shaped metal patterns to converge the radiating beams in the propagation direction of the radiating beams outputted from the radiating element.

46. The method according to claim 45, wherein the antenna radome is made of a metamaterial.

47. The method according to claim 45, wherein a gap between the S-shaped metal patterns ranges from 0.002 to 0.2 times of a wavelength of a resonance frequency of the radiating element.

48. The method according to claim 45, wherein a gap between the inverse S-shaped metal patterns ranges from 0.002 to 0.2 times of a wavelength of a resonance frequency of the radiating element.

49. The method according to claim 45, wherein the dielectric layers comprise more than two dielectric material layers having the same magnetic coefficient.

50. The method according to claim 45, wherein the dielectric layers comprise more than two dielectric material layers having different magnetic coefficients.

51. The method according to claim 45, wherein the dielectric layers comprise more than two dielectric material layers, one portion of which has the same magnetic coefficient, and the other portion of which has different magnetic coefficients.

52. The method according to claim 45, wherein the dielectric layers comprise more than two dielectric material layers having the same dielectric constant.

53. The method according to claim 45, wherein the dielectric layers comprise more than two dielectric material layers having different dielectric constants.

54. The method according to claim 45, wherein the dielectric layers comprise more than two dielectric material layers, one portion of which has the same dielectric constant, and the other portion of which has different dielectric constants.

55. The method according to claim 45, wherein the radiating element is an antenna.

56. The method according to claim 45, wherein the S-shaped metal patterns and the corresponding inverse S-shaped metal patterns are disposed in pairs, and the inverse S-shaped metal patterns are obtained by rotating the corresponding S-shaped metal patterns according to one axis to be opposite in order to the corresponding S-shaped metal patterns.

* * * * *